US008382171B2

(12) United States Patent
Williams

(10) Patent No.: US 8,382,171 B2
(45) Date of Patent: Feb. 26, 2013

(54) SELF-ADJUSTING STRIKER ASSEMBLY

(75) Inventor: David A. Williams, Milton, FL (US)

(73) Assignee: Daws Manufacturing Company, Inc., Pensacola, FL (US)

( * ) Notice: Subject to any disclaimer, the term of this patent is extended or adjusted under 35 U.S.C. 154(b) by 261 days.

(21) Appl. No.: 12/714,893

(22) Filed: Mar. 1, 2010

(65) Prior Publication Data

US 2011/0210568 A1 Sep. 1, 2011

(51) Int. Cl.
*E05B 15/02* (2006.01)
*E05C 19/00* (2006.01)

(52) U.S. Cl. ..... 292/341; 292/341.18; 292/1

(58) Field of Classification Search ..... 292/340, 292/341.12, 341.13, 341.15, 341.18, 341.19
See application file for complete search history.

(56) References Cited

U.S. PATENT DOCUMENTS

| | | | | |
|---|---|---|---|---|
| 148,662 | A | 3/1874 | Burr | |
| 446,173 | A | 2/1891 | Hancock | |
| 2,275,760 | A | 3/1942 | Hoffman | |
| 2,428,207 | A | 9/1947 | Dzurinda | |
| 2,669,477 | A | 2/1954 | Jewell | |
| 3,179,458 | A * | 4/1965 | Sconzo | 292/341.15 |
| 4,305,611 | A * | 12/1981 | Robins | 292/238 |
| 4,432,575 | A | 2/1984 | Garvey et al. | |
| 4,470,626 | A | 9/1984 | Gergoe et al. | |
| 4,480,862 | A * | 11/1984 | Fleming | 292/162 |
| 4,522,436 | A * | 6/1985 | Hoen et al. | 292/113 |
| 4,988,134 | A | 1/1991 | Vidwans et al. | |
| D319,001 | S | 8/1991 | Weinerman et al. | |
| 5,161,851 | A * | 11/1992 | Rafi-Zadeh | 296/26.07 |
| 5,193,868 | A | 3/1993 | O'Toole | |
| 5,226,302 | A | 7/1993 | Anderson | |
| 5,342,103 | A | 8/1994 | Tame et al. | |
| 5,524,978 | A * | 6/1996 | Tunis et al. | 312/216 |
| 5,707,092 | A | 1/1998 | Van Slembrouck et al. | |
| 5,938,254 | A * | 8/1999 | Weyerstall | 292/341.16 |
| 6,149,213 | A | 11/2000 | Sokurenko et al. | |
| 6,334,560 | B1 | 1/2002 | Lentini | |
| 6,502,435 | B2 * | 1/2003 | Watts et al. | 70/95 |
| 6,783,163 | B2 * | 8/2004 | Sadler | 292/341.18 |
| 6,817,637 | B1 | 11/2004 | Anderson | |
| 7,032,417 | B2 * | 4/2006 | Toulis et al. | 70/97 |
| 7,261,337 | B2 | 8/2007 | Nakagome et al. | |
| 7,322,127 | B2 * | 1/2008 | Hwang | 34/603 |
| 7,416,228 | B2 * | 8/2008 | Pfitzinger et al. | 292/216 |
| 7,469,945 | B2 | 12/2008 | Dennis | |
| 7,744,135 | B2 * | 6/2010 | Wiese et al. | 292/341.15 |
| 2006/0145487 | A1 | 7/2006 | Wilder | |
| 2009/0108591 | A1 * | 4/2009 | De Vries | 292/64 |

FOREIGN PATENT DOCUMENTS

| | | | |
|---|---|---|---|
| AU | 703274 | B2 | 7/1996 |
| CA | 1046552 | A1 | 1/1979 |
| CN | 200943344 | Y | 9/2007 |
| FR | 2752865 | A1 | 3/1998 |

* cited by examiner

*Primary Examiner* — Thomas Beach
*Assistant Examiner* — Nathan Cumar
(74) *Attorney, Agent, or Firm* — GrayRobinson P.A.

(57) ABSTRACT

A self-adjusting striker assembly, for use with a box having a lid, a box body and a latch, includes a striker bar mounted to the lid which is operative to move linearly relative to the latch in the event of misalignment between the lid and box body.

16 Claims, 5 Drawing Sheets

SELF-ADJUSTING STRIKER ASSEMBLY

FIELD OF THE INVENTION

This invention relates to tool boxes, and, more particularly, to a self-adjusting striker assembly for use with latches in tool boxes that accommodates misalignment between the lid of the box and the latches.

BACKGROUND OF THE INVENTION

One of the most popular accessories for trucks and recreational vehicles is a truck tool box used to store and secure a variety of tools and other items in the bed of the vehicles. There are a number of different types of truck boxes, including cross-over boxes, side mount boxes, chest boxes, top mount boxes, RV boxes and others. Each truck box is typically formed of aluminum tread plate, and comprises a front wall, a back wall, a bottom wall and opposed end walls which are interconnected to define a hollow interior. The truck box interior is closed by a top lid that is pivotal on one or more hinges, usually with the assistance of gas springs.

In many truck box designs, one or more latch mechanisms and striker bars are provided to maintain the top lid in a closed and locked position to secure the contents of the box. The latch mechanism(s) may be mounted to the front wall of the box, for example, in which case the striker bar(s) is mounted to the top lid. When the top lid is closed, each striker bar engages a latch mechanism to lock the top lid in place. In order for the striker bar and latch to properly engage one another, they must be in alignment, which, in turn, depends on appropriate alignment of the top lid and the body of the truck box. Many factors can contribute to altering the relationship between the top lid and box body, including rough handling during shipment, improper installation on the vehicle, damage to the body panels of the box during off-road adventures or the like and other factors. If each latch does not align with a striker bar, adjustment must be made in order for the top lid to properly close and lock.

Many striker bar—latch constructions in the prior art permit manual adjustment of the striker bar with respect to the latch. Typically, the position of the striker bar may be altered by loosening nuts securing the striker bar to the top lid or front wall of the box and then manually shifting its position relative to the latch. This can be a tedious exercise, and seems to invariably occur when the vehicle owner has the least amount of time to correct the situation.

Self-adjusting striker bar assemblies have been suggested in the prior art as a means of providing at least some adjustment of the position of the striker bar relative to the latch without the need for manual intervention. See, for example, U.S. Pat. Nos. 7,416,228 and 5,342,103. In these patents, the striker bar is pivotally mounted to the top lid or box body and can move in a swinging, pendulum-type motion relative to the latch mechanism which is mounted on or adjacent to a plate formed with a notch. In the event of misalignment between the striker bar and latch mechanism, the striker bar contacts a side of the notch and pivots to a position in alignment with the latch mechanism.

SUMMARY OF THE INVENTION

This invention is directed to a self-adjusting striker assembly for use with a truck box, or essentially any other type of box, having a hollow interior defined by a front wall, a back wall, a bottom wall, opposed end walls and a pivotal top lid. The self-adjusting striker assembly provides for linear movement of a striker bar, in a direction between the end walls of the box, so that it can properly align with a latch mechanism even if the relationship between the top lid of the box and the box body is altered.

In one presently preferred embodiment, the self-adjusting striker assembly of this invention may comprise a base mounted to the top lid of the box assuming the latch mechanism is connected to the box body. The base is formed with an elongated recess within which first and second threaded studs are mounted. A generally L-shaped bracket is provided including a bottom plate formed with first and second openings separated by a partition, and a perpendicular side plate having a slot for mounting a striker bar. The first and second studs of the base are received within respective openings in the bottom plate of the bracket, and such openings at least partially overlie the elongated recess in the base. A first spring is placed in the recess of the base, and extends into the first opening of the bottom plate of the bracket between the first stud and partition. A second spring is placed in the same position in the second opening of the bottom plate. The bottom plate of the bracket is sandwiched between the base and a capture plate which rests atop the bottom plate and mounts to the studs extending from the base.

Unlike the prior art noted above, the self-adjusting striker assembly of this invention permits movement of the bracket, and, in turn, the striker bar, in a linear, side-to-side direction. A guide plate formed with a notch may be mounted to or in proximity with each latch mechanism so that in the event of misalignment between the striker bar and latch mechanism the striker bar may contact the notch in the guide plate and shift its position from side-to-side so as to properly align with and engage the latch mechanism. Additionally, the position of the striker bar within the slot in the side plate of the bracket may be manually adjusted.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
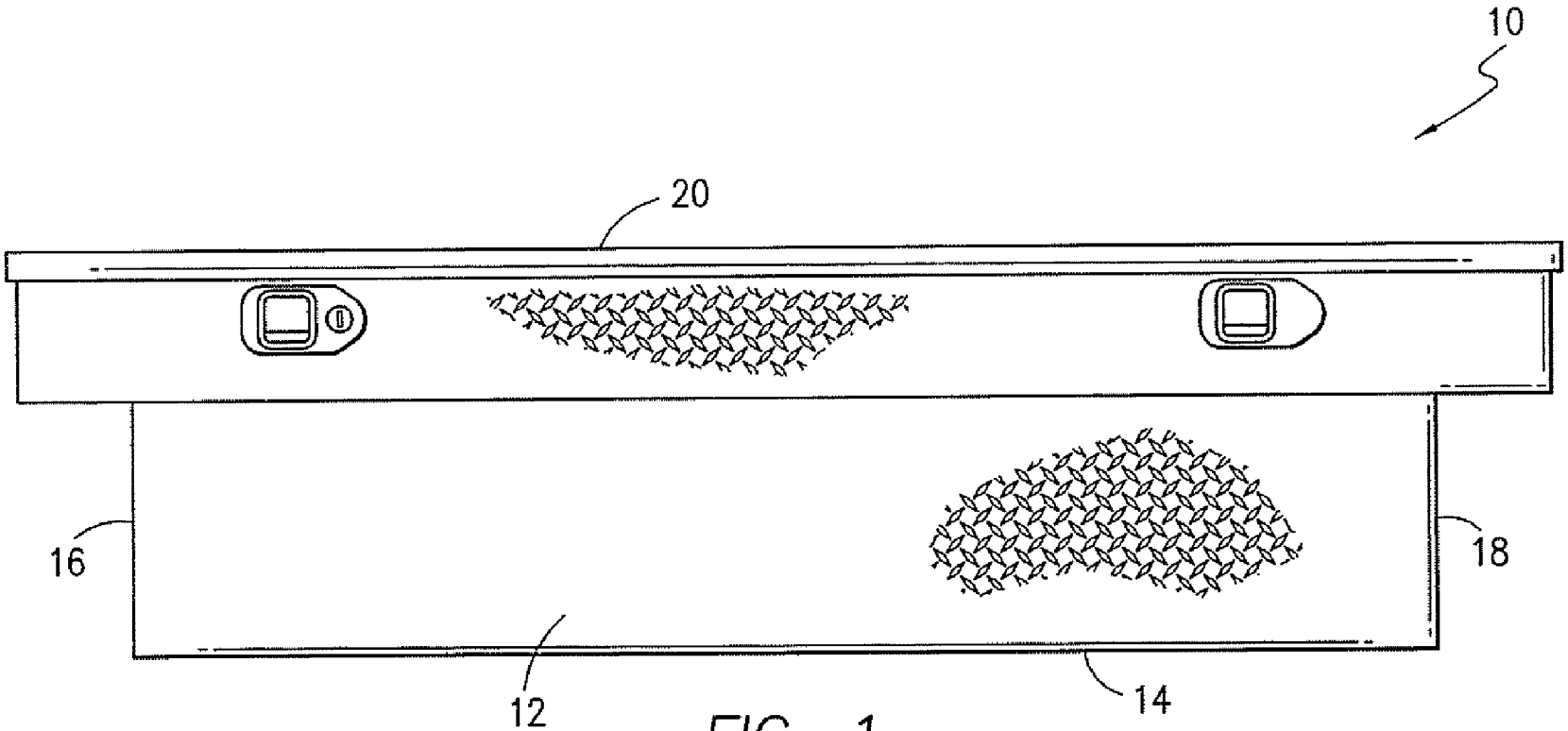
FIG. 1 is a front view of one type of truck box with which the self-adjusting striker assembly of this invention may be utilized.

Referring initially to FIG. 1, a truck tool box 10 is schematically depicted which comprises a front wall 12, a back wall (not shown), a bottom wall 14, opposed end walls 16 and 18, and, a top lid 20 pivotally mounted to the back wall. The walls 12-18 are interconnected to form a hollow interior. It should be understood that the particular configuration of the box 10 shown in FIG. 1 is intended for purposes of illustration only, and the invention described below is applicable to essentially any type of box including various other truck tool boxes such as side mount boxes, chest boxes, top mount boxes and RV boxes. For purposes of the present discussion, terms "front," "rear," "top," "bottom," "upwardly," "downwardly," "inwardly," "outwardly" and the like refer to the orientation of the truck tool box 10 as viewed in FIG. 1.

Figure 2:
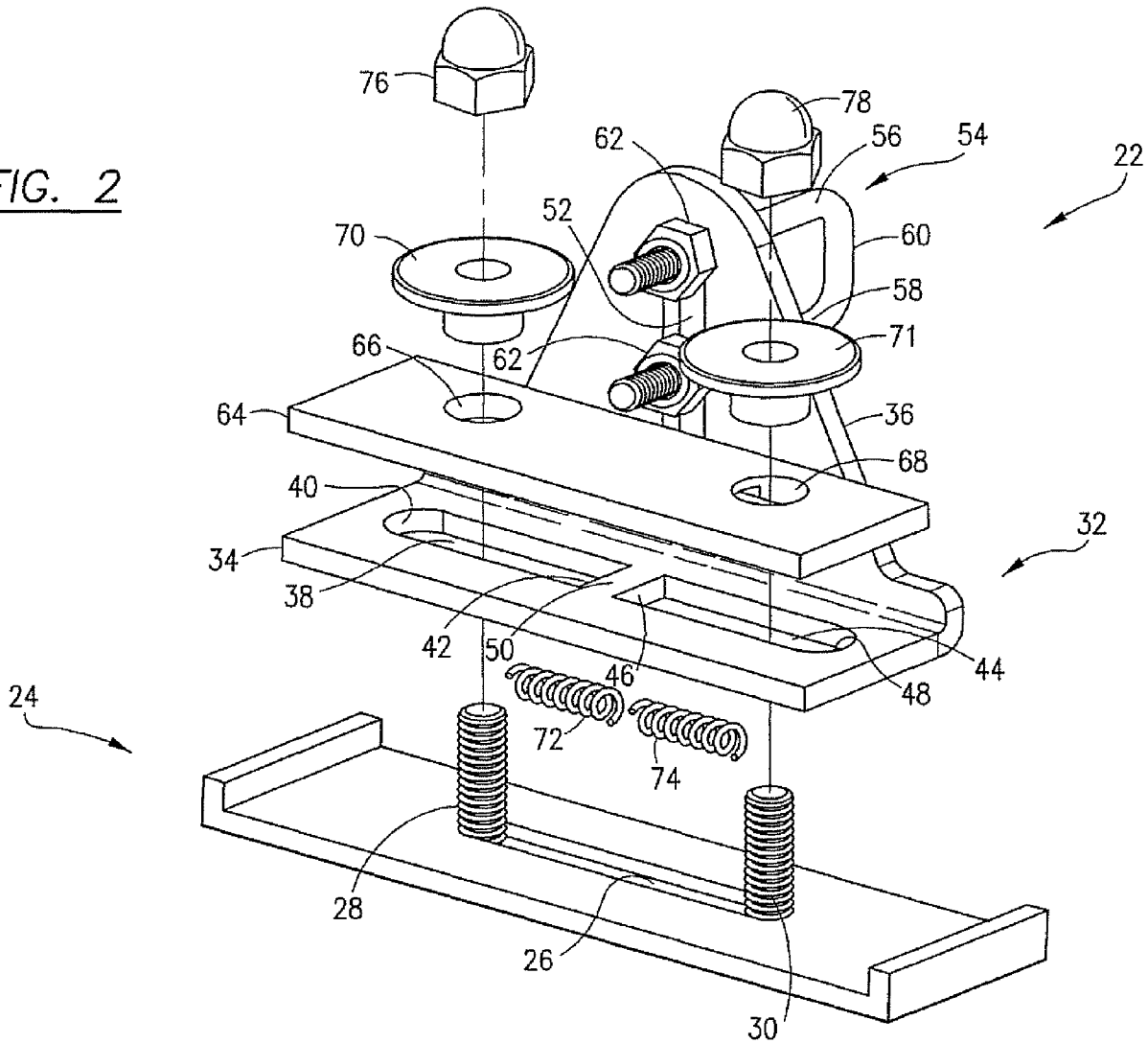
FIG. 2 is a disassembled, perspective view of the assembly herein.
Figure 3:
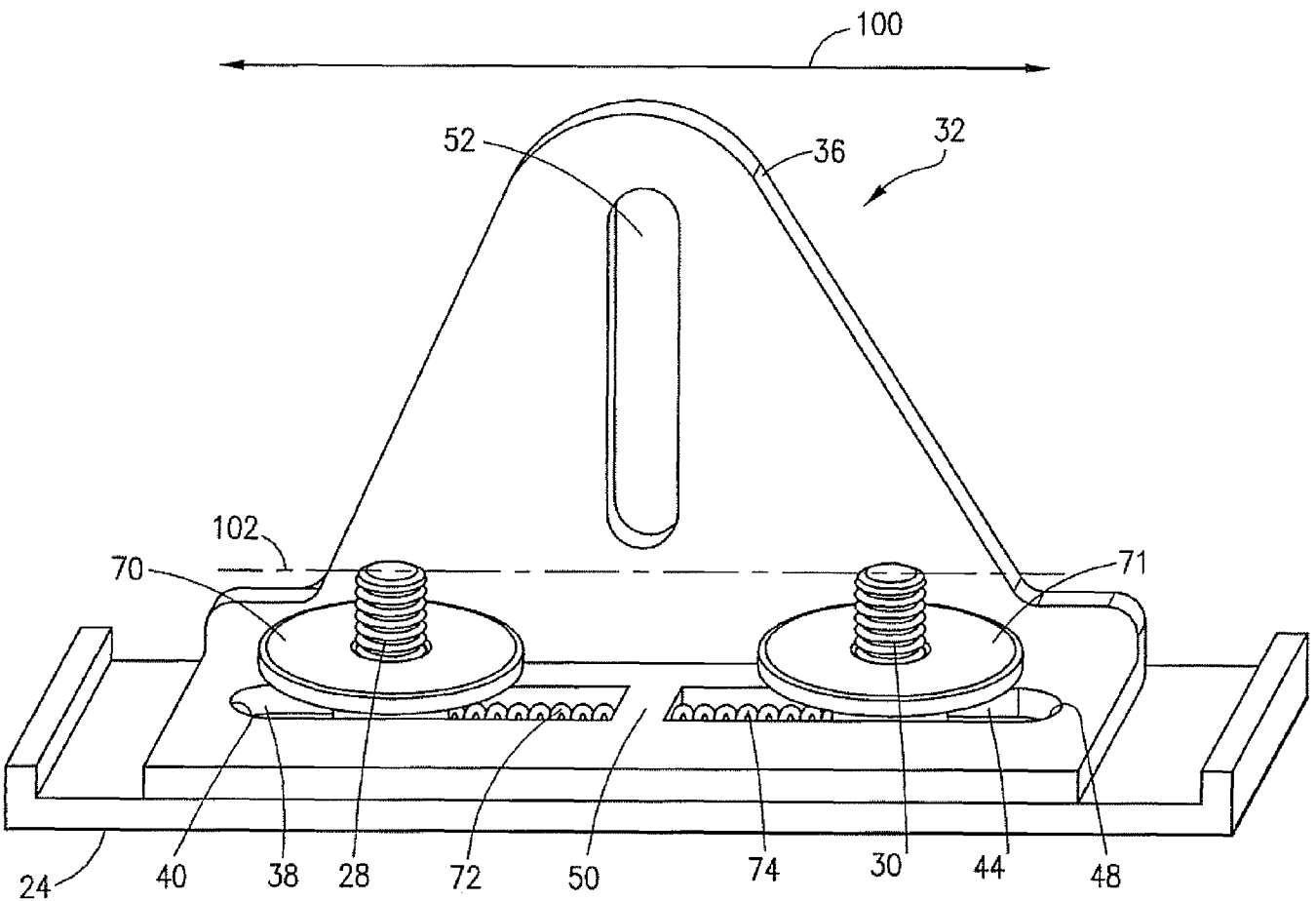
FIG. 3 is a perspective view of a portion of the assembly shown in FIG. 1.

Referring now to FIGS. 2 and 3, the self-adjusting striker assembly 22 of this invention is illustrated. The assembly 22 comprises a base 24 formed with an elongated recess 26. A threaded stud 28 is mounted at one end of the recess 26, and a second threaded stud 30 is mounted at the opposite end. A generally L-shaped bracket 32 is mounted to the base 10, as described below, and it is formed with a horizontally extending bottom plate 34 connected to or integrally formed with a vertically extending side plate 36.

The bottom plate 34 of bracket 32 is formed with a first opening 38 having opposed ends 40 and 42, and, a second opening 44 having opposed ends 46 and 48. The ends 42 and 46 of openings 38, 44, respectively, are separated by a partition 50. The side plate 36 of the bracket 32 is formed with a vertically extending, elongated slot 52 which mounts a striker bar 54, preferably in the form of a U-bolt. The striker bar 54 has spaced arms 56 and 58 connected by a cross member 60. The end of each arm 56, 58 is threaded to receive nuts 62, one located on either side of the side plate 36, and the position of the striker bar 54 may be adjusted vertically along the slot 52 by loosening the nuts 62, sliding the striker bar 54 to the desired position, and then tightening the nuts 62. A capture plate 64 is also provided which is formed with spaced through holes 66 and 68. Each through hole 66, 68 receives a flange washer 70 and 71, respectively.

The striker assembly 22 may be assembled as follows. Initially, the bottom plate 34 of the bracket 32 is placed onto the base plate 24 so that the stud 28 extends through the first opening 38 in the bottom plate 34 and the stud 30 extends through the second opening 44. As best seen in FIG. 3, a first coil spring 72 is fitted into the recess 26 in base 24 and into that portion of the first opening 38 in the bottom plate 34 of bracket 32 between the partition 46 and stud 28, e.g. the ends of the first coil spring 72 extend between the end 42 of opening 38 and stud 28. Similarly, a second coil spring 74 is fitted into the recess 26 and into that portion of the first opening 44 in the bottom plate 34 between the partition 50 and the stud 30.

With the coil springs 72, 74 in place, the capture plate 64 may be positioned atop the bottom plate 34 of bracket 32 such that the stud 28 of base 24 extends through the opening 66 of the capture plate 64 and the stud 30 extends through the opening 68 therein. The flange washer 70 is inserted through the through hole 68 in capture plate 64, and then through the opening 38 in the bottom plate 34 of bracket 32, onto the stud 28. A portion of the stud 28 protrudes upwardly from the capture plate 64 to receive a cap nut 76. The flange washer 71 is assembled in the same way onto stud 30, and a second cap nut 78 may be tightened down on the exposed end of the stud 30. FIG. 3 illustrates the flange washers 70 and 71 in place on respective studs 28, 30, with the capture plate 64 being removed for ease of illustration. The capture plate 64 and flange washers 70, 71 position the bottom plate 34 of the bracket 32 such that a space is provided between the stud 28 and the end 40 of opening 38 in bottom plate 34 and between the stud 30 and the end 48 of the opening 44.

Figure 4:
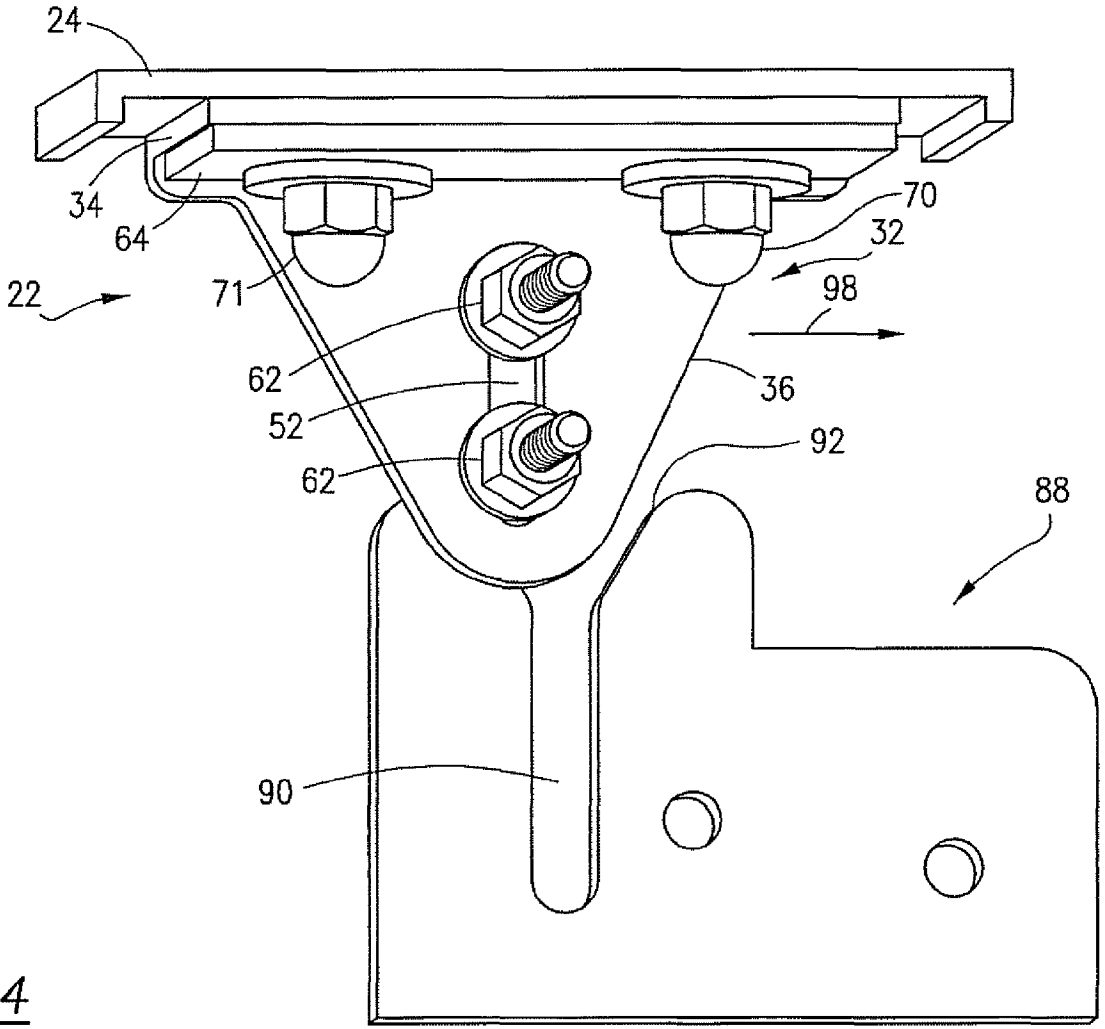
FIG. 4 is a perspective view of the assembly, in an assembled condition, and a guide plate employed with a latch mounted to the truck box.
Figure 5:
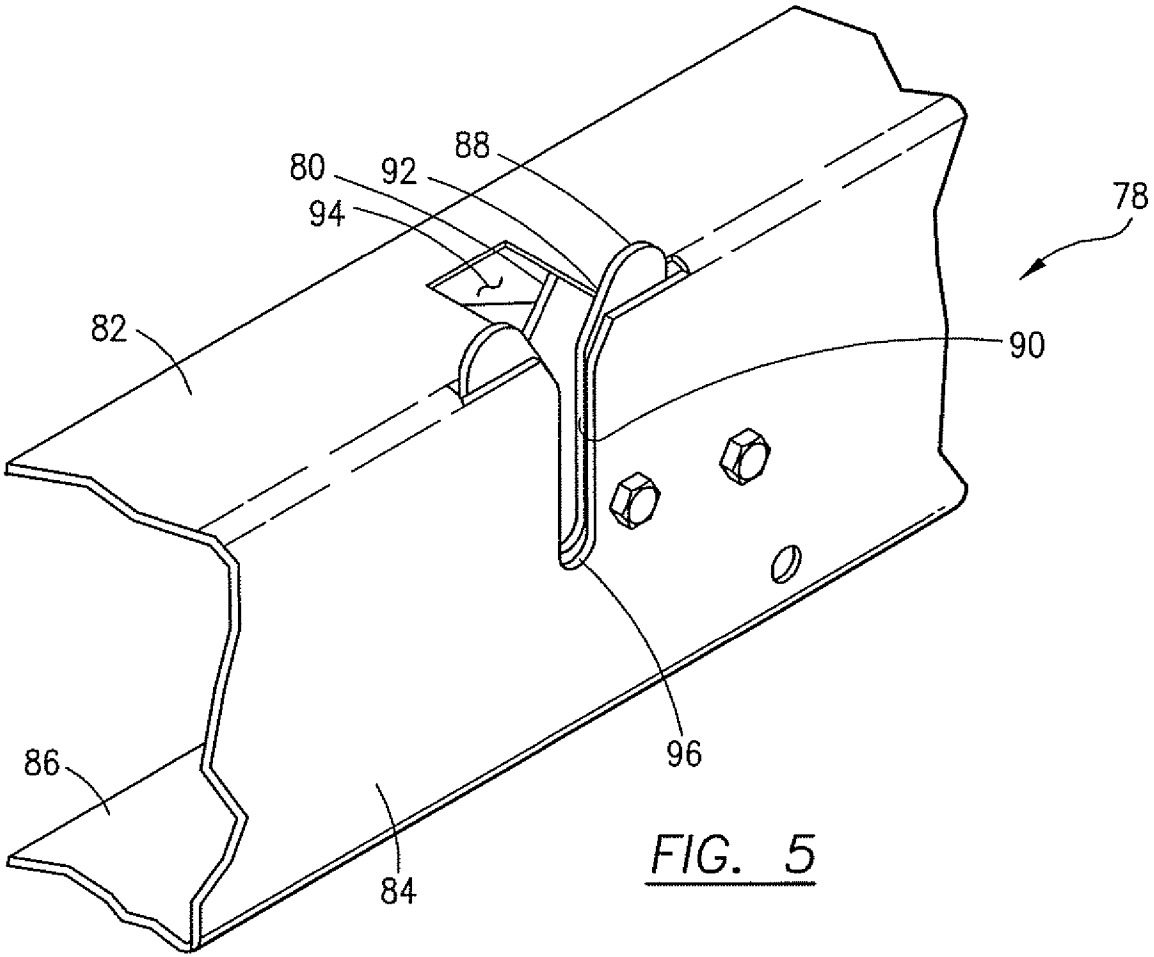
FIG. 5 is perspective view of a portion of a mounting rail located along the front wall of the truck box, showing a portion of a latch and the guide plate depicted in FIG. 4.

As noted above, the striker assembly 22 of this invention is employed with a latch to close, and in some designs, lock the box 10. Referring to FIGS. 4 and 5, a mounting rail 78 may be connected to the front wall 12 of the box 10 to receive and mount a latch 80. The mounting rail 78 has a top plate 82, a side plate 84 and a bottom plate 86 which are connected to form a channel structure as shown in FIG. 5. Only a portion of the mounting rail 78 is depicted in FIG. 5, and it should be understood that it extends along the length of the front wall 12 between the end walls 16, 18. Additionally, preferably two latches 80 and two striker assemblies 22 are employed with most boxes 10.

In the presently preferred embodiment, a guide plate 88 is either mounted on or immediately adjacent to the latch 80. The guide plate 88 is formed with a notch 90 having an expanded mouth or open end 92. A cutout 94 is formed in the top plate 82 of mounting rail 78, and a slot 96 extends along its side plate 84. As seen in FIG. 5, the latch 80 and guide plate 88 are connected to the mounting rail 78 so that the open end 92 of the guide plate 88 aligns with the cutout 94 and its notch 90 aligns with the slot 96 in side plate 84.

In the preferred embodiment, the striker assembly 22 may be mounted to the top lid 20 of the box 10 and the latch 80 may be connected to the moving rail 78 in alignment with the striker assembly 22, e.g. the orientation depicted in FIG. 4. However, it should be understood that the positions of the striker assembly 22 and latch 80 could be reversed. The latch 80 has been removed in FIG. 4 for clarity, and for purposes of the discussion below.

The first and second coil springs 72, 74 bias the bracket 32 to a neutral position as depicted in FIG. 3. The term "neutral" in this context refers to a centered position of the bottom plate 34 of bracket 32 on the base 24. If the striker assembly 22 and latch 80 are correctly aligned with one another, as the top lid 20 is closed the striker bar 54 enters notch 90 in guide plate 88 and extends into engagement with the latch 80 without contacting the guide plate 88 along its open end 92. In the event of misalignment between the striker bar 54 and latch 80, as the top lid 20 is closed the striker bar 54 makes contact with the open end 92 of the notch 90 in guide plate 88. For purposes of illustration, the striker bar 54 is shown engaging the left-hand side of the open end 92 of notch 90 in FIG. 4. With such misalignment, upon contact of the striker bar 54 with the open end 92 of notch 90 the bracket 32 moves to the right along base 10 in the direction of arrow 98. As the top lid 20 continues to close, the striker bar 54 slides along the side of open end 92 and then enters the notch 90 in guide plate 88 so that it can properly engage the latch 80.

Referring to FIG. 3, the connection between the base 24 and bracket 32 allows for side-to-side movement of the bracket 32 with respect to base 24 in the direction of arrow 100. Such movement is linear, e.g. generally along an axis 102 extending in between the studs 28, 30, as schematically depicted in FIG. 3. When misalignment between the striker bar 54 and the notch 90 in guide plate 88 occurs, the bracket 32 is moved to the left or to the right as viewed in FIG. 3 thus compressing one of the first and second coil springs 72, 74. For example, movement of the bracket 32 to the right as viewed in FIG. 3 causes the second coil spring 74 to compress in between stud 30 and partition 50. The opposite stud 28 acts as a stop to limit such right-hand movement because the end 40 of opening 38 in the bottom plate 34 of bracket 32 engages the stud 28 thus preventing further movement to the right. The extent of travel of the bracket 32 to the right is governed by the space between the stud 28 and the end 40 of the opening 38 in bottom plate 34. The same thing occurs upon movement of the bracket 32 to the left as viewed in FIG. 4, e.g. the first coil spring 72 is compressed between the stud 28 and partition 50, and the stud 30 stops such movement to the left upon engagement with the end 48 of opening 44 in the bottom plate 34 of bracket 32. Once the striker bar 54 disengages the latch 80, such as when the top lid 20 is moved to an open position, whichever coil spring 72, 74 that was compressed, as noted above, biases the bracket 32 back to the neutral position.

The striker assembly 22 provides a convenient means of accommodating misalignment between the striker bar 54 and latch 80 in a side-to-side direction, e.g. linearly, generally along axis 102. In some instances, the striker bar 54 may fail to properly engage the latch 80 due to a vertical misalignment. The term "vertical misalignment" refers to the relative position of the striker bar 54 and latch 80 when the top lid 20 is closed, wherein the striker bar 54 fails to seat within the latch 80 or is positioned too close to the latch 80. In that event, as noted above, the striker bar 54 may be moved along the slot 52 in the side plate 36 of bracket 22 in a direction toward or away from the latch 80 when the top lid 20 is closed.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A box, comprising:

a number of interconnected walls forming a hollow interior having an open top, a lid movable between an open position and a closed position relative to said open top;

a latch mounted to one of said walls or to said lid;

a striker assembly comprising:

(a) a base mounted to the other of said one wall and said lid, said base having a first post and a second post spaced from said first post;

(b) a bracket formed with a first opening and a second opening separated by a partition, said bracket being mounted to said base in such a way as to permit movement of said bracket relative to said base generally along a first axis with said first post extending through said first opening and said second post extending through said second opening;

(c) a first spring located within said first opening and extending between said first post and said partition, a second spring located within said second opening and extending between said second post and said partition;

(d) a striker bar mounted to said bracket in position to engage said latch upon movement of said lid to said closed position, said bracket being movable generally along said first axis in the event of misalignment between said striker bar and said latch.

2. The box of claim 1 in which said bracket includes a bottom plate connected to a side plate oriented generally perpendicular to said bottom plate, said bottom plate being formed with said first and second openings.

3. The box of claim 2 in which said side plate is formed with an elongated slot, said striker bar being mounted to said side plate and movable within said elongated slot to selected positions relative to said bottom plate.

4. The box of claim 3 in which said elongated slot extends generally perpendicular to said bottom plate.

5. The box of claim 2 further including a capture plate formed with a first bore and a second bore, said capture plate overlying said bottom plate of said bracket in position to receive said first post within said first bore and said second post within said second bore.

6. The box of claim 5 in which each of said first and second posts is a threaded stud, said capture plate securing said bottom plate of said bracket to said base by nuts tightened onto exposed ends of said studs.

7. The box of claim 5 in which said capture plate positions said bracket relative to said base such that said first post of said base is spaced from an edge of said first opening in said bracket and said second post of said base is spaced from an edge of said second opening, said bracket being movable relative to said base along said first axis in a first direction and in an opposite second direction, said first post contacting said edge of said first opening to limit the extent of motion of said bracket in said first direction and said second post contacting said edge of said second opening to limit the extent of motion of said bracket in said second direction.

8. The box of claim 1 further including a guide plate formed with a slot, said guide plate being positioned relative to said latch to direct said striker bar along said slot and into engagement with said latch in the event of misalignment between said striker bar and said latch.

9. The box of claim 1 in which said base is formed with a recess, each of said first and second coil springs extending into said recess when located within respective first and second openings in said bracket.

10. A striker assembly for use with a box formed by a number of interconnected walls defining a hollow interior with an open top, a lid moveable relative to the open top between an open and closed position, and, a latch mounted to said lid or to one of said walls, said striker assembly comprising:

a base mounted to the other of said one wall and said lid, said base having a first post and a second post spaced from said first post;

a bracket formed with a first opening and a second opening separated by a partition, said bracket being mounted to said base in such a way as to permit movement of said bracket relative to said base generally along a first axis with said first post extending through said first opening and said second post extending through said second opening;

a first spring located within said first opening and extending between said first post and said partition, a second spring located within said second opening and extending between said second post and said partition;

a striker bar mounted to said bracket in position to engage said latch upon movement of said lid to said closed position, said bracket being movable generally along said first axis in the event of misalignment between said striker bar and said latch.

11. The striker assembly of claim 10 in which said bracket includes a bottom plate connected to a side plate oriented generally perpendicular to said bottom plate, said bottom plate being formed with said first and second openings.

12. The striker assembly of claim 11 in which said side plate is formed with an elongated slot, said striker bar being mounted to said side plate and movable within said elongated slot to selected positions relative to said bottom plate.

13. The striker assembly of claim 11 further including a capture plate formed with a first bore and a second bore, said capture plate overlying said bottom plate of said bracket in position to receive said first post within said first bore and said second post within said second bore.

14. The striker assembly of claim 13 in which each of said first and second posts is a threaded stud, said capture plate securing said bottom plate of said bracket to said base by nuts tightened onto exposed ends of said studs.

15. The striker assembly of claim 13 in which said capture plate positions said bracket relative to said base such that said first post of said base is spaced from an edge of said first opening in said bracket and said second post of said base is spaced from an edge of said second opening, said bracket being movable relative to said base along said first axis in a first direction and in an opposite second direction, said first post contacting said edge of said first opening to limit the extent of motion of said bracket in said first direction and said second post contacting said edge of said second opening to limit the extent of motion of said bracket in said second direction.

16. The striker assembly of claim 10 in which said base is formed with a recess, each of said first and second coil springs extending into said recess when located within respective first and second openings in said bracket.

* * * * *